US007559424B2

(12) United States Patent
Stensland

(10) Patent No.: US 7,559,424 B2
(45) Date of Patent: Jul. 14, 2009

(54) METHOD OF MAKING MINIATURE PLANTS OR FLOWERS AND KIT THEREFOR

(76) Inventor: Arnulv O Stensland, 323 Harris Rd., Monticello, NY (US) 12701

( * ) Notice: Subject to any disclaimer, the term of this patent is extended or adjusted under 35 U.S.C. 154(b) by 515 days.

(21) Appl. No.: 10/513,802

(22) PCT Filed: Apr. 28, 2003

(86) PCT No.: PCT/US03/13038

§ 371 (c)(1),
(2), (4) Date: Jun. 6, 2005

(87) PCT Pub. No.: WO03/090571

PCT Pub. Date: Nov. 6, 2003

(65) Prior Publication Data

US 2005/0214482 A1 Sep. 29, 2005

(51) Int. Cl.
*A41G 1/00* (2006.01)

(52) U.S. Cl. ..... 206/575; 428/26; 156/61

(58) Field of Classification Search ..... 206/575, 206/577; 428/24, 26; 156/61
See application file for complete search history.

(56) References Cited

U.S. PATENT DOCUMENTS 2,062,276 A 11/1936 Burton
2,282,657 A 5/1942 Kirchen
3,147,699 A * 9/1964 Land ..... 101/211
4,014,088 A 3/1977 Oshier
5,756,166 A * 5/1998 Shinohara ..... 428/24
5,934,044 A 8/1999 Weder
6,000,139 A 12/1999 Chan
6,089,137 A 7/2000 Lee

FOREIGN PATENT DOCUMENTS

FR 2 345 094 3/1976
JP 02300305 12/1990

* cited by examiner

*Primary Examiner*—Jacob K Ackun, Jr.
(74) *Attorney, Agent, or Firm*—Carter, DeLuca Farrell & Schmidt LLP.

(57) ABSTRACT

Kit (100) and method for making plants or flowers comprising a plurality of flower shaped paper punches (12) with at least some of the paper punches provided with a water soluble color mark and put together into a container (10). With a flower punch placed on a pliable surface (32) a smooth edged tool (34) is used for forming at least one curve in the flower punch by pressing this tool down near the center of the flower punch and pulling it outwardly toward the outer edge of the flower punch. Then the curved flower punch is attached to an elongated flexible stem member.

4 Claims, 8 Drawing Sheets

METHOD OF MAKING MINIATURE PLANTS OR FLOWERS AND KIT THEREFOR

BACKGROUND

1. Technical Field

The present disclosure relates to a method and kits for making miniature plants and more particularly for making miniature flowers and flower arrangements.

2. Description of Related Art

Miniature flower punches have been available which are configured to punch out various flower-shaped flat punches. However, a need exists for methods and kits to make realistic appearing flowers or flower arrangements made from such flower punches.

SUMMARY

In one embodiment, the present disclosure provides a kit having a plurality of flower shaped paper punches formed from card stock material, wherein at least some of the paper punches have a water soluble color mark formed on a portion of at least one side of the paper punch thereto. The mark is formed in a predetermined configuration and at a predetermined location on the paper punches for subsequent dispersion thereon. A container is also provided which is configured and dimensioned to receive and retain the plurality of flower punches.

In another embodiment, the present disclosure provides a method of forming miniature flowers from flower shaped paper punches which includes the steps of placing a flower punch formed of paper on a pliable surface; forming at least one curve in the flower punch by pressing down with a smooth edged tool near the center of the flower punch such that the punch is pushed into the pliable surface and pulling outwardly on the smooth edged tool toward the outer edge of the flower punch; and attaching the curved flower punch to an elongated flexible stem member.

In one aspect of the presently disclosed method, the step of dispersing a coloring agent on the flower punch may be included. Such dispersing step may include the sub-steps of: applying a water soluble color mark on the flower punch; wetting the flower punch; and pressing the flower punch to spread the coloring agent.

In another aspect of the present disclosure, the method may include the step of applying decorative particulate material such as sawdust or powder at the end of the stem.

In another embodiment, the present disclosure provides a kit for making miniature plants or flowers including a plurality of flower shaped paper punches formed from card stock material; at least one miniature container configured and dimensioned to arrange and display finished miniature flowers therein; at least one quantity of decorative particulate material; a foam block; an instructional video; an instructional pamphlet; at least one elongated flexible stem member; at least one foam pad sheet; and a container configured and dimensioned to contain each of the kit components.

In one aspect of the present disclosure, the kit may further include a tool kit including a plurality of flower forming tool attachments.

In another embodiment of the present disclosure a tool kit is provided for forming miniature plants or flowers and includes a hollow tubular housing; a plurality of tool attachments including at least two attachments selected from the group consisting of at least a ball-tipped stylus, a spatula shaped attachment, a spoon-shaped pick, a horn-shaped circular ended pick, a needle pointed tool, and a dimple-ended pick, each said tool attachment being configured and dimensioned to fit inside the hollow tubular housing, the tool attachments having an end effector formed at a first end thereof and having an elongated shaft portion terminating at a second end portion; and a clamp member secured to one end of the housing and adapted to releasably retain the elongated shaft portion of each of the plurality of tool attachments.

BRIEF DESCRIPTION OF THE DRAWING FIGURES

FIG. 3A is a side elevation view of a curved forming tool attachment of FIG. 3;

FIG. 3B is a perspective view of a horn-shaped forming tool attachment of FIG. 3;

FIG. 3C is a side elevation view of a dimpled-end forming tool attachment of FIG. 3;

DETAILED DESCRIPTION OF PREFERRED EMBODIMENTS

Figure 1:
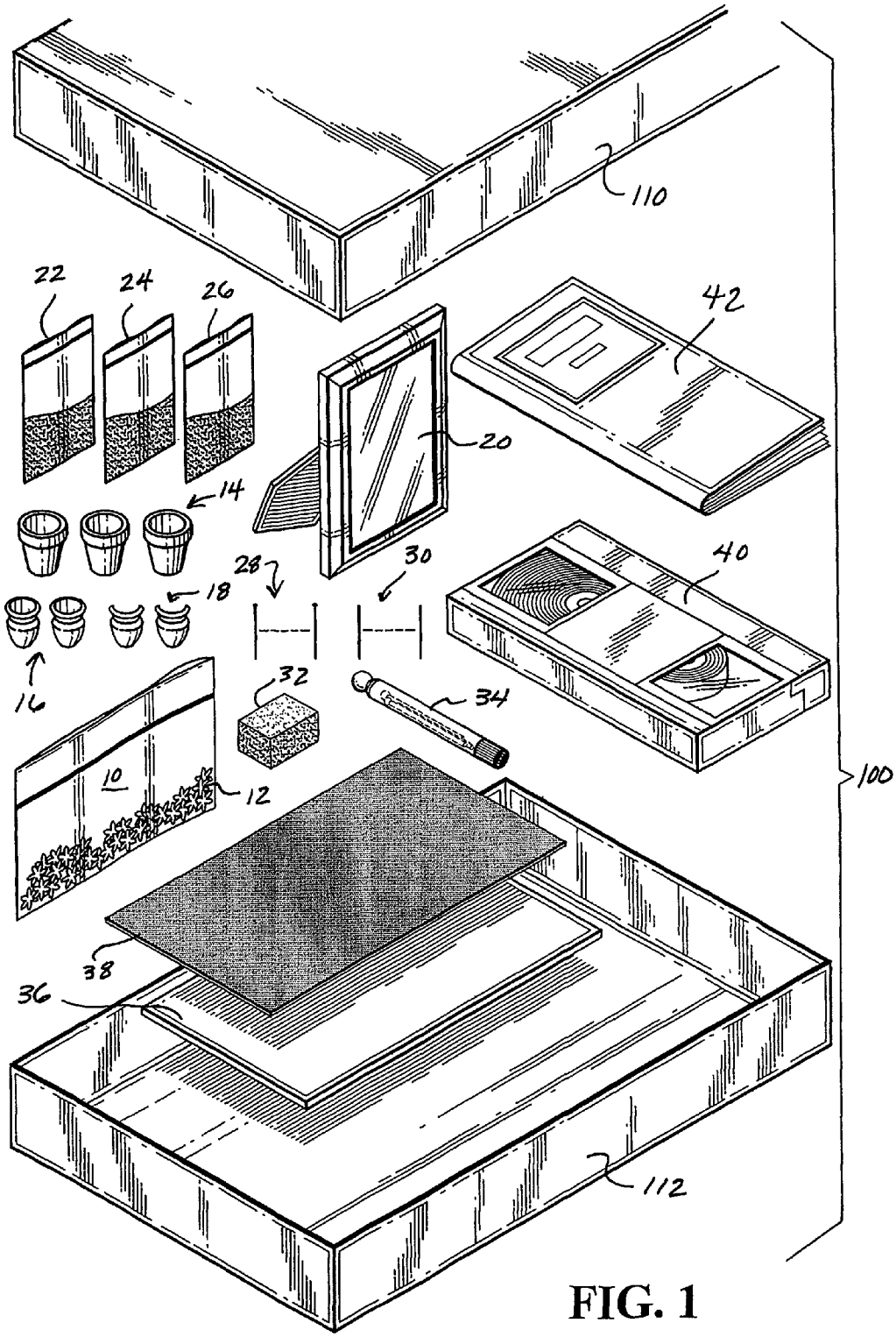
FIG. 1 is a perspective view of one exemplary embodiment of a kit for making miniature flowers and flower arrangements.

Referring now to the drawing figures wherein similar reference numerals represent similar or identical elements throughout the several views and initially to FIG. 1, one illustrative embodiment of a kit for making miniature flowers is designated generally as kit 100 which has an enclosure such as a box including top 110 and bottom 112 which are configured and dimensioned to contain the various component parts that make up kit 100.

Items which may be included in kit 100 are, for example, a resealable packet 10 containing a plurality of flower punches 12 which are shaped in the form of one or more flower types, a plurality of ornamental containers, for example, miniature flower pots 14, miniature vases 16, miniature half-vases 18, and picture frame 20, each being configured and dimensioned for retaining and displaying finished flower arrangements therein. Also included in kit 100 is at least one packet of decorative material, for example, packets 22, 24, 26 each of which may contain a predetermined quantity of decorative material. One example of a decorative material is a particulate ornamental substance such as powder, sawdust, grindings, dirt, or the like. The materials may be of different colors and/or textures to provide the user with a variety of options when forming flowers.

Also included in kit 100 are a quantity of thin elongated members such as pin-headed wire lengths 28 and non-pin-headed wire lengths 30, which will form the stems of the completed flowers. Alternatively, a continuous predetermined length of wire could be supplied in kit 100 such as 26 gauge florist wire which is preferably green in color and can be cut into the desired length by the user to form the individual flower stems.

A quantity of a pierce-able material, such as a dried cellulose material, for example, foam block 32 may be included in kit 100 and is preferably configured and dimensioned to retain the stems of the formed flowers therein. Alternatively a quantity of clay could be provided in place of or in addition to foam block 32.

Other items contained in kit 100 may include a flower forming tool such as multi-tool kit 34, at least one rigid sheet of material such as board 36, at least one sheet of soft material such as foam pad sheet 38, an instructional video 40, and an instructional book 42. It is envisioned that the contents of kit 100 may include all of the above-mentioned elements as well as other items not shown in FIG. 1, such as a variety of different sheets of colored card or paper stock; a bonding agent or glue suitable for adhering objects or particulate material to paper or card stock; coloring agents, for example, water-soluble markers, dyes, paints or the like; paint brushes; a grasping instrument such as tweezers; a vessel configured and dimensioned to retain fluid and permit immersion of flower punches therein.

Flower punches 12 may be formed in various shapes and each kit 100 may contain one or more packets 10 of flower punches 12, each packet containing a different shaped flower punch. For example, various different flower punches which may be included in kit 100 include the following shapes: rounded small six petal flower 12*a*, small tear drop 12*b*, star 12*c*, heart 12*d*, circle 12*e*, five petal flower 12*f*, five petal lotus 12*g*, large six petal flower 12*h*, large tear drop 12*i*, sun 12*j*, oval 12*k*, and circle 12*l*, each of which are shown in FIGS. 2A through 2L, respectively.

Referring to FIGS. 3, and 3A through 3E, multi-tool kit 34 includes a hollow tubular housing 44 forms an enclosure for housing various tools or tool portions. A clamp member such as pin vice 46 is secured at a first end thereof and a removable closure such as threaded cap 48 is secured at a second end thereof. The tubular housing may be solid and continuous as shown or, alternatively it may be a split-housing type wherein the separate halves are removably joined together, by any suitable joining techniques such as threaded connection, friction fit, detent mechanism, bayonet-type lock, or the like. In such an embodiment, a clamp member may be provided at both ends of the housing to facilitate the mounting of two tools simultaneously to the housing.

Multi-tool kit 34 includes a plurality of tool attachments each of which are configured and dimensioned to fit inside hollow tubular housing 44 and include one end which is in the form of a shaft configured and dimensioned to be detachably retainable in pin vice 46. The tool attachments include a spatula shaped attachment such as spade pick 49, a spoon-shaped pick 50, a first ball-tipped stylus 52, a second ball-tipped stylus 54 which is of a larger diameter than stylus 50, a horn-shaped circular ended pick 56, a needle pointed tool 58, and a dimple-ended pick 60.

The miniature flowers are formed by initially applying a coloring agent to provide a natural color appearance to the individual flowers. Color accents may be added by coloring at least a portion of the flower punch, which is preferably made of card stock paper, with a coloring agent such as, for example a conventional water soluble marker. For some flowers, it is envisioned that the coloring step may not be necessary or desired. For example, for white flowers which may be made from white card stock flower punches or other uniformly colored flowers which may be formed from card stock flower punches of the color desired.

As shown in the illustrative examples of FIGS. 4A-4E, the color may be applied to the flower punches in a variety of schemes. The marking schemes shown in FIGS. 4A-4E are illustrative of types of markings which may be added to the petals. However, various other marking schemes are also envisioned and are within the scope of the present disclosure.

Figure 4A:
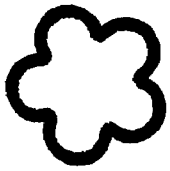
FIG. 4A is an exemplary flower punch having a coloring agent applied around the periphery thereof.
Figure 4B:
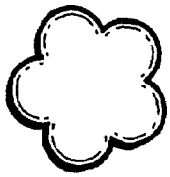
FIG. 4B is an exemplary flower punch having a coloring agent applied on the outer edge thereof.

As shown in FIG. 4A, color accents may be added by tracing an outline around the periphery of the flower punch which when completed as will be described further herein, will add color highlights such that the color is darker around the periphery and gets lighter toward the center of the flower. Alternatively, for a more subtle accent as shown in FIG. 4B, the coloring may be added around the periphery of the flower punch on the edge thereof.

Figure 4C:
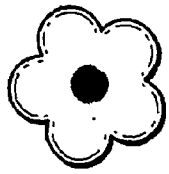
FIG. 4C is an exemplary flower punch having a coloring agent applied as a dot in the center thereof.
Figure 4D:
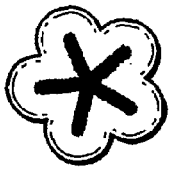
FIG. 4D is an exemplary flower punch having a coloring agent applied in a series of lines radiating from the center thereof.
Figure 4E:
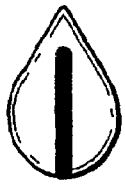
FIG. 4E is an exemplary flower punch having a coloring agent applied as a line down the center thereof.

FIG. 4C shows the coloring added by placing a dot in the center of the punch. In this manner when the color dispersion is complete the flower will have a darker color in the center and will lighten toward the outer portions. FIG. 4D illustrates adding color by marking lines radiating from the center to each of the petals. In this manner, the completed flower will have individual petals which are darker along the centerline of the petals and lighter toward the outer edges. Another scheme of adding color is shown in FIG. 4E for tear-drop shaped punches by marking a line longitudinally down the center of the flower punch. Upon completion this will produce the effect of a dark central longitudinal axis and gradual lightening toward the outer edges.

Flower punches may be pre-formed and pre-marked in the various shapes and color schemes shown and described herein as well as others. Such pre-formed and colored flower punches may be packaged in resealable packets 10 and included as part of kit 100 or packaged and sold separately.

Figure 5:
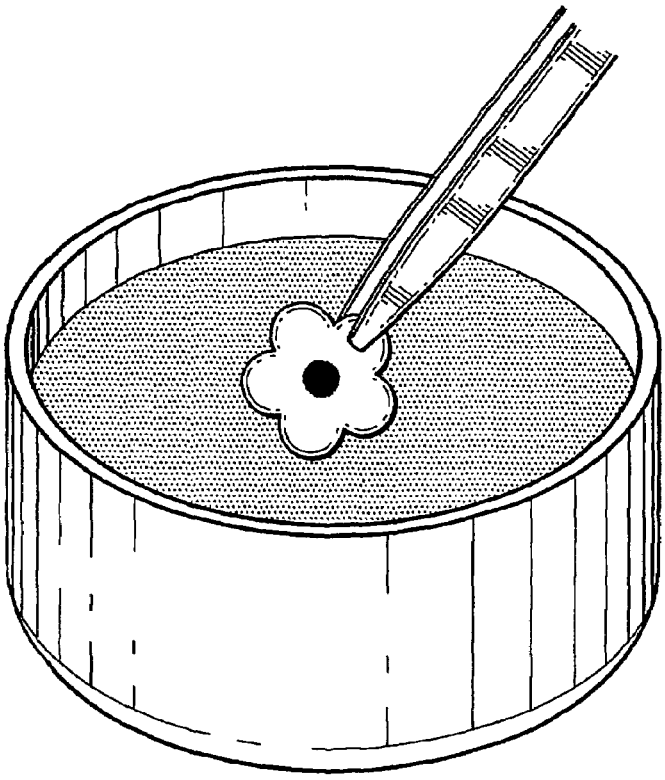
FIG. 5 is a perspective view which illustrates immersion of a flower punch into a liquid bath.
Figure 6:
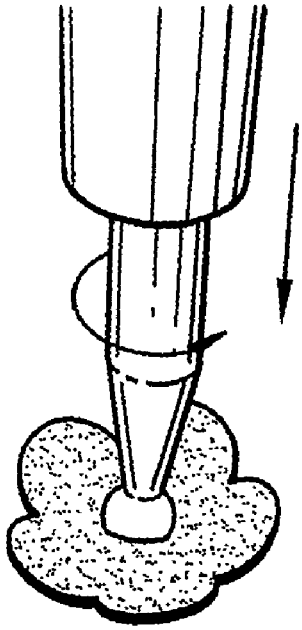
FIG. 6 is a perspective view which illustrates a color dispersion and flower forming sequence of the flower punch.
Figure 7:
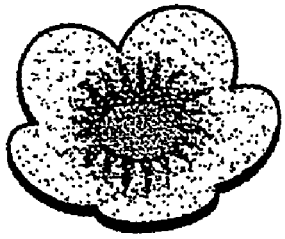
FIG. 7 is a perspective view which illustrates an exemplary flower punch with a coloring agent dispersed thereon.

As shown in FIGS. 5-7, the color applied to the flower punches is dispersed throughout the surface of the flower punch. The color dispersion is achieved by initially wetting the desired number of flower punches to be formed, for example, by applying the water to the flower with a paintbrush dipped in water or by submerging the flower punches in water using a grasping instrument such as tweezers, as is shown in FIG. 5. The wetting of the flower punch achieves a certain amount of color dispersion initially. Additionally, the flower punches soften and become more pliable upon penetration thereof by the water, which should only take a few seconds.

The flower punch is then placed on a base material such as a layer of thin foam sheet material such as foam pad sheet 38 (FIG. 1). Depending upon the desired curvature for the finished petals, additional layers of foam pad sheets 38 may be used to permit the petal to curve further into the padding layers beneath it. Additional color dispersion and structural forming features of the flower are achieved by using a tool to press the flower punch into the foam pad sheet(s) 38. For example, as shown in FIG. 6, a rounded end tool such as either first ball-tipped stylus 52 or second ball-tipped stylus 54 is set at the center of the flower punch where the color mark has been made (see FIG. 4C). The tool is pressed into the flower punch and turned simultaneously. In this manner, a dimple is formed in the center of the flower punch and the color is dispersed from the center outwardly toward the edges of the flower punch. Creases and crevices are formed on the edge of the petals. Thus, the previously flat flower punch exhibits the texture characteristics of a natural flower.

To disperse the color on any of the other illustrated color marking schemes shown in FIGS. 4A, 4B, 4D, or 4E, the rounded end tool may be used to trace the outline of the color mark while pressing into the foam pad sheet(s) 38. Alternatively, particularly for the flower punches which have one or more straight line color marks thereon, for example, FIGS. 4D and 4E, a blade-style tool such as spade pick 49 (FIG. 3) may be used to press into the flower punch tracing the lines in order to form a vein-like dispersion of the color.

An alternative method of forming colored flower punches is by using a bleach solution during the forming process. By bleaching the card stock first it is possible to get many more variations of color, depending on the ratio of bleach to water. Instead of wetting the flower punch with water as in the previous embodiment, a solution of bleach and water is used to bleach the card stock material. On effective solution has been found to be approximately ten parts water and approximately one part bleach.

Figure 10:
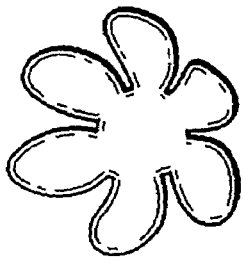
FIG. 10 is a perspective view of the flower punch of FIG. 8 after each of the petals has been curled.
Figure 11:
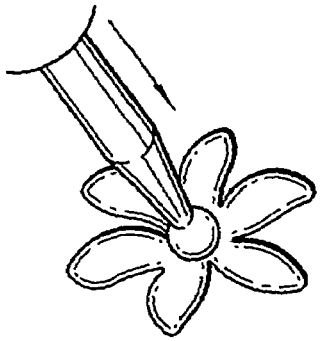
FIG. 11 is a perspective view of a further forming sequence.

Referring to FIGS. 8-12 additional flower shaping and forming may be performed either after the color dispersion process or simultaneous thereto. Additionally, it may be desirable to form flowers from flower punches where the color dispersion process is eliminated. The following method may be used in either case. For example, the flower punch is placed on one or more foam pad sheets 38 then with ball-tipped stylus 52 or 54 the user presses down at the base of each petal and pulls outwardly to the outer edge while pushing the petal down into the foam pad sheet 38. In this manner, each of the petals can be curled as shown in FIG. 10. Once each of the petals has been curled, the user gently turns the flower punch over and using the ball-tipped stylus pushes in at the center of the flower punch as shown in FIG. 11. Thereafter, the formed flowers are permitted to dry before adding stems as will now be described.

Figure 13:
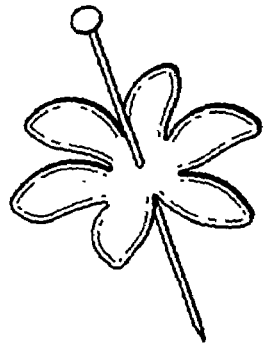
FIG. 13 is a perspective view of a further forming sequence wherein a stem is attached to the flower.
Figure 9:
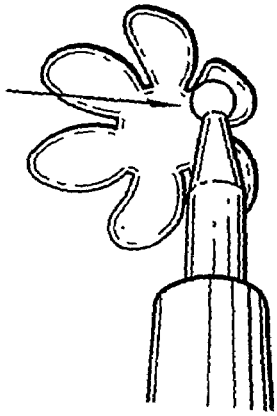
FIG. 9 is a perspective view of a forming sequence.
Figure 12:
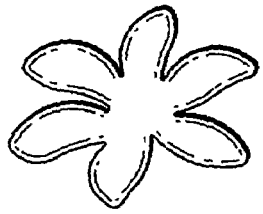
FIG. 12 is a perspective view of a completed flower prior to attachment to a stem.
Figure 8:
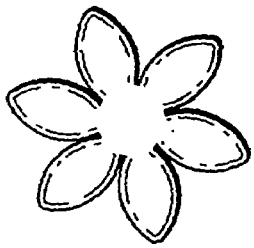
FIG. 8 is a perspective view of an exemplary flower punch.

The flower stems are formed by using an elongated flexible member such as, for example pre-cut wire lengths 28 or 30. If the pre-cut wire length has a pointed end like stem 28, the user may simply push the pointed end through the center of the formed flower punch as shown in FIG. 13. If the stem does not have a pointed end like stem 30, a pointed end instrument such as needle pointed tool 58 (FIG. 1) may be used to punch a hole through the flower punch center and the end of the stem 28 or 30 is inserted in the hole. Thereafter, the free end of the wire stem 28 is pulled from the bottom. Additional bonding agent is placed at the point where the folded part meets the stem. The wire is slowly pulled until the bonding agent just touches the flower. Thus, when the bonding agent dries it will hold the flower to the wire. The end of the stem 28 with the glue and particulate matter will resemble the stamen of the flower.

Alternatively, a spool of 26 gauge florist wire may be cut to lengths which are preferably in scale proportion with the flowers, for example approximately 2.54 cm (1 inch) to approximately 5.08 cm (2 inches) in length, depending on how tall a flower is desired. A small loop may be formed at one end of the cut length of wire and bent to form a right angle with the remaining un-bent portion of the stem.

Figure 16:
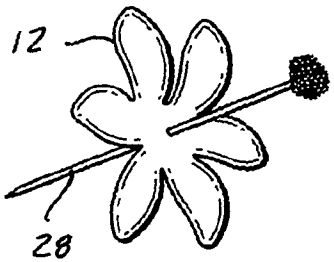
FIG. 16 is a perspective view which illustrates the particulate matter adhered to the flower stem at one end thereof.
Figure 17:
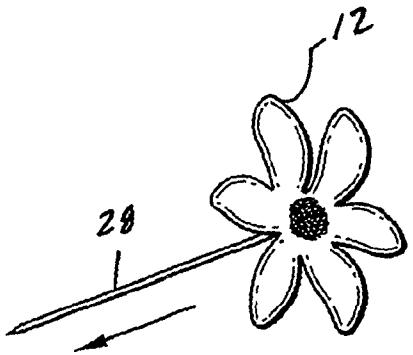
FIG. 17 is a perspective view which illustrates the final sequence of forming the flower.
Figure 15:
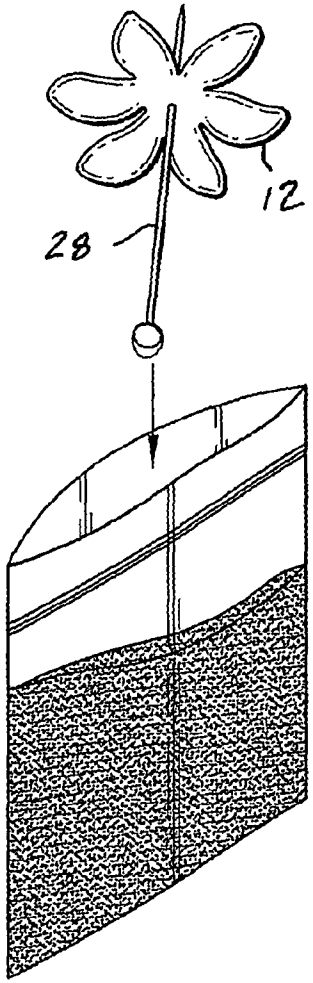
FIG. 15 is a perspective view of a further forming sequence wherein an ornamental feature is added to the flower.
Figure 14:
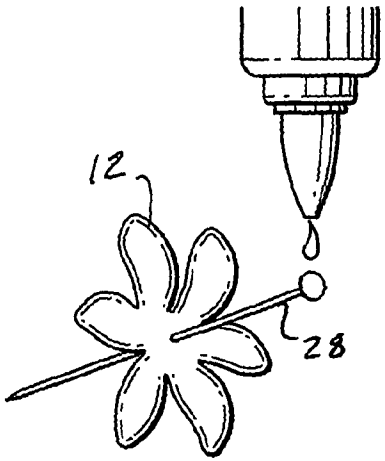
FIG. 14 is a perspective view of a further forming sequence.
Figure 18:
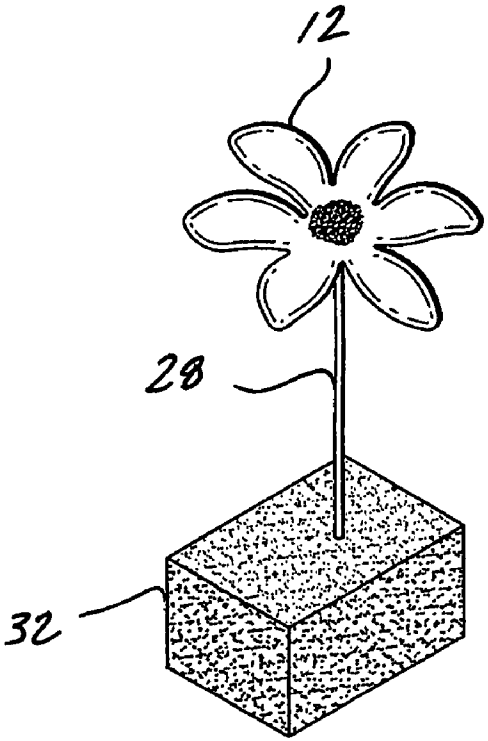
FIG. 18 is a perspective view which illustrates a formed flower retained vertically in a block of porous or penetrable material.

The flower may be attached to the stem is by a bonding agent or glue such as, for example, an extra thick formulation of cyanoacrylate to the end as shown in FIG. 14. Referring to FIGS. 15-17, the glue coated end of the stem is then dipped into a desired particulate material such as sawdust to provide a coating at the end of the stem. One effective material is T48 Flower Dust available from Woodland Scenics (Linn Creek, Mo., USA). If the small loop is not formed at the end, then the glue and particulate material mixture will appear as a cone shape at the end of the wire. Different colored particulate matter material or sawdust may be utilized as desired or necessary to form a given flower color. The stem 28 is then pulled while holding flower punch 12 until the end of stem 28 becomes seated at the center of the flower punch 12 as shown in FIG. 17. This will form a rounded shaped stamen. If it is desired to retain the cone shaped stamen, then the cone is allowed to dry before pulling the stem to meet the flower punch. Thereafter, the formed flower may be allowed to dry by sticking the base of the wire stem in a block of dried cellulose material such as foam block 32 as shown in FIG. 18.

After allowing sufficient time for the glue to dry, additional ornamental features characteristic of the object being formed may be added if desired. For example, a leaf-shaped cut out formed from paper may be adhered to the underside of the flower at a location which obscures the wire loop.

In an alternative method of attaching flower punches 12 to the stems, with the dried flower punches turned upside down, the loop of the stem is coated with an adhesive, such as white craft glue, and is thereafter placed on the center of the back of the flower punch. The dimples in the center of the flower are colored by any suitable method. For example they may be colored with ink applying instruments such as colored pens, pencils, and markers or by applying paint with a fine pointed brush.

An alternative method of applying color to the flower centers as well as adding the appearance of texture is facilitated by adhering material to the dimpled center. One example of such a method is accomplished by placing a drop of glue on the dimpled center of the flower. One effective method of depositing a drop of glue without depositing excess glue in the area surrounding the center is by using a thin elongated tool such as a wooden skewer which is dipped in glue and then touched to the center of the flower to place a drop on the dimple only. Thereafter, color and texture may be added to the flower's center by depositing decorative material on the wet glue. For example, sawdust may be sprinkled on the glue to give the appearance of a real flower. To achieve different colors, different types of naturally colored sawdust may be used as desired. Alternatively, the sawdust can also be painted when dried or the folded end can be painted, for example with acrylic paint.

Figure 19:
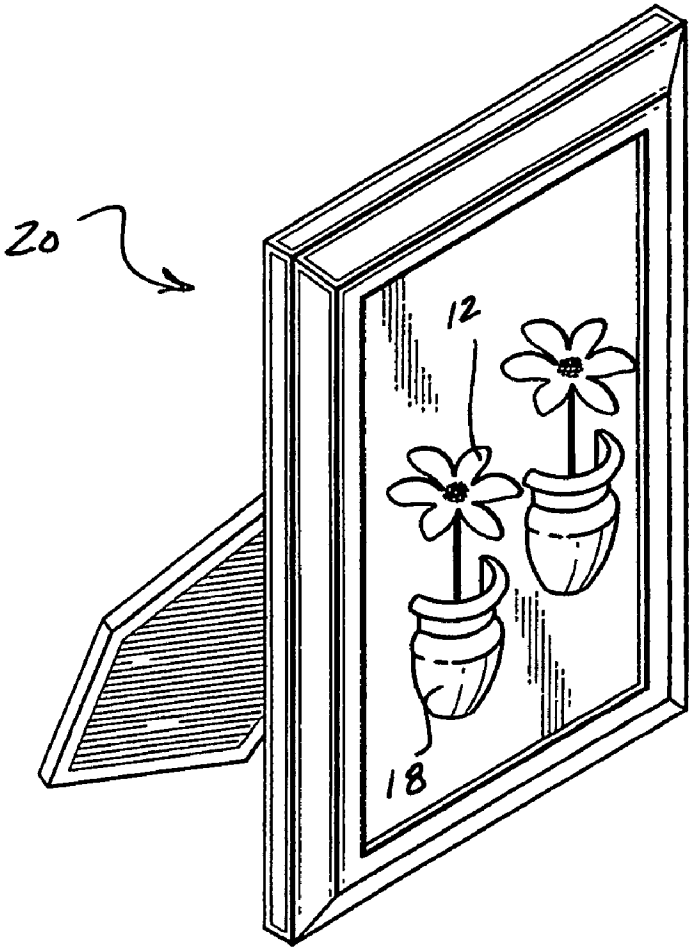
FIG. 19 is a perspective view which illustrates one exemplary finished arrangement of miniature flowers.

When the flowers are completed, the user can arrange them as desired in either a free standing miniature pot 14 or vase 16, for example by placing some foam material in the pot or vase and embedding the bottom of the flower stem therein. Other materials may also be placed in the containers to hold the flowers, for example, clay may be glued in the container and the flower stems embedded in the clay. In this manner, when the clay hardens, the glue will retain it in the container and the hardened clay will retain the flowers in the arranged positions. Alternatively, as shown in FIG. 19, the finished flowers may be arranged in half-vases 18 in the same fashion as described above for the miniature pot 14 or vase 16 and secured to a picture frame for display.

By using variations of the above method, different flower types are readily formed. For example, a miniature flower resembling a cherry blossom may be formed using pink card stock and redwood sawdust. The flower punches are lifted and placed on two layers of foam pad 38 to create a double layer which will facilitate forming a greater curvature on the individual petals. Additional or fewer layers of foam padding may be used to achieve the desired curvature of the petals or leaves being formed. The rounded end tool 52 or 54 is used to apply pressure at the center of the flower punch, and is thereafter pressed and turned. In this manner, the flower punch will resemble a horn shaped flower and will have creases and crevices, but no dimple. Thereafter the formed flower is dried.

Once the formed flower is dry a sharp pointed tool such as a pick or needle tipped implement such as a hatpin is used to poke a hole in the bottom center of the flower. The flower stem is then added in any of the previously noted methods.

In order to form leaves to be applied to the flowers, a similar process to that described above with slight modifications may be utilized. A few tear drop punches 12*i* (FIG. 2I) are placed on a dry sheet material such as aluminum foil. Leaves can be made with a pointed or rounded tip of the leaf, depending upon which end of the tear drop is attached to the stem.

In order to form the detailed features of a leaf with a pointed tip, the leaf blank tear drop punch 12*i* is held by the pick and using a dark marking pen, preferably in the same color as the leaf blank a line is drawn from the rounded part of the teardrop to just before the pointed tip of the teardrop shaped leaf blank, as shown in FIG. 4E. The leaf blank is moistened as previously noted, for example, by applying water with a paintbrush dipped in water or immersing it in a water bath as shown in FIG. 5.

The teardrop punch 12*i* will become soft and pliable as the water permeates the blank. Thereafter the blank is placed on a foam pad. The point of the blank is pressed down in a motion similar to that if one were attempting to cut the leaf in half longitudinally, for example, by using spade pick 49 and pulled to the center of the rounded part of the teardrop blank. This forms the centerline of the leaf and also causes the formation of wrinkles and crevices that extend from the sides of the leaf to the centerline in the direction that the pick 49 is pulled. If a rounded leaf is desired, the procedure is reversed. During this process, the ink spreads through the leaf giving it a variegated look.

Using the basic method described above, many different types of flowers may be formed. For example, to form dahlias four or more green leaves are formed as noted above. A stem is formed as described above to have a loop defined at a right angle to the stem. The leaves are bonded to the under part of the stem.

The petals of the dahlias are formed by punching out eight or more tear drop punches per flower from whatever colored card stock is desired for the finished dahlia. The tear drop punches are placed on a dry flat sheet material such as aluminum foil. The teardrop blank is held in a fixed position, for example, by a pick. A line is drawn from the rounded part of the teardrop almost to the tip of the teardrop. The teardrop shaped blank is moistened as previously described.

The teardrop shaped punches are placed on the foam pad. With the spade pick, press down on the point of the teardrop and pull to the center of the rounded edge to make the crease in the flower petal. If rounded petal tips are desired, the procedure is reversed. The ink will spread giving the petals a variegated look. The petals are permitted to dry. Thereafter, four petals are bonded to the top of the stem above the leaves already bonded to the stem to resemble a cross shape. The remaining four petals are bonded between the other petals to form an eight pointed star. If desired, more petals can be added. A drop of bonding agent is placed on the center and is covered by sprinkling sawdust over the wet bonding agent.

Flowers such as violas and pansies may be formed using a heart-shaped punch. These type flowers are made slightly different from the method described above. For each flower, three heart shaped flower punches 12*d* (FIG. 2D) are used. The petal blanks are placed flat sheet material. The heart shaped punches are moistened as previously noted herein. If a bleaching is desired to modify the colors, blue punches may be used and the punches may be moistened, with a paintbrush dipped in a solution of approximately ten parts water to approximately one part bleach, wet and are allowed to dry. When dried the blanks will turn a very pale blue. A purple colored marker may then be used to color the pointed section of the heart-shaped petal blanks. One particularly effective type of marker is a non-toxic washable marking pen.

The heart shaped petal blank is placed on a dry sheet material and is wet where colored with the marker to cause the color to bleed the purple ink. The punches are placed on the foam pad. A rounded end instrument such as ball tipped stylus 52 or 54 is used to press slightly with the large ball on the purple section of the blank. In this manner, the ink will bleed into the heart. The ink will spread in proportion to the amount of force applied by the stylus. If the outside of the blank is left clear it will give you a two-tone effect. The petal is allowed to dry and, thereafter additional purple ink may be applied to the point of the heart.

An alternative method of coloring the petals is to color them first with a purple marking pen at the point of the heart. The blank is then wet with a paintbrush dipped in water and is placed it on a foam pad. Using the ball-tipped stylus the blank is pressed where the ink is. When the blanks are almost dry, the paintbrush is dipped in the solution comprised of approximately ten parts water and approximately one part bleach. Preferably only the opposite side where it is not purple is wet. The violet portion will turn a light blue.

The petals are allowed to dry and the petals are glued together such that the points of the heart overlap. After the blanks are dry a small hole is formed in the center, for example with a pin. A stem is formed as previously described herein. The folded end of the stem is dipped into a bonding agent and then sawdust or acrylic paint is applied as noted above. The other end of the stem is inserted through the hole formed with the pin. The end of the stem is pulled until the folded part touches the flower and the assembled flower is allowed to dry, for example by placing it in a pierceable material, for example, foam block 32. When making pansies, the same process may be used but with different colors.

Roses may also be made using the kit of the present disclosure. In order to make roses a large dark green dot is formed using a marking pen in the center of a flower punch (as shown in FIG. 4C) made from green card stock. The blank is wetted as previously noted and then placed on a double thickness of foam sheets 38. Using a stylus with a small end such as ball-tipped stylus 52, the user presses and turns (FIG. 6) to make a horn shaped flower (FIG. 7). This flower becomes the green base of the rose.

About twelve heart shaped punches (FIG. 2D) from pink card stock are used for each rose to be formed. The heart shaped punches are placed on a dry sheet material such as aluminum foil. With a red marking pen, a large dot is made at the pointed end of the heart punch. Then the flower punch is wet with a paintbrush dipped in water. These punches will become the petals of the rose.

Once the petals become soft and pliable they are placed on a foam pad sheet 38 (FIG. 1). With a large end of the stylus 52 or 54, the heart shaped punch is pressed to resemble a rose petal. The stylus in a slight circle as pressure is applied. Alternatively, the horn-shaped tool 56 may be used in a rocking motion to form each of the heart shaped flower punches 12*d* into the petals of the rose. After the petals are dry, four petals are glued to the stem with a point of the petals touching the stamen, and inside the green horn shaped flower.

When the petals dry the end of the petal is painted with water until they curl over like a natural rose petal. After the petals dry, four more petals are glued to the flower, placing them between the first group of petals. When dry, the process is repeated with the paintbrush to curl the next group of four petals. Then a petal is wetted and rolled in a small cone shape. Another petal tip is dipped in some glue and attached it to the cone just formed. In this manner a rose bud is formed. The bud is glued to the center of the flower that was previously made. After the glue dries, the petals of the bud that were glued to the center of the rose are curled by wetting them with a paintbrush dipped in water. Care should be taken not to use too much water or the glue may become weakened. Alternatively, glues can be used that are not water soluble.

Figure 2A:
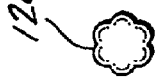
FIGS. 2A through 2L illustrate various exemplary shapes of flower punches which may be incorporated in the kit of FIG. 1.
Figure 2B:
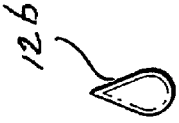
Figure 2C:
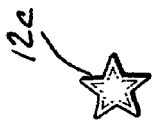
Figure 2D:
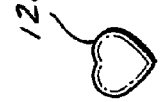
Figure 2E:
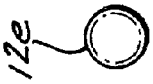
Figure 2F:
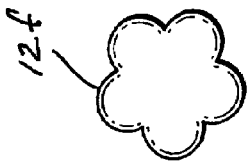
Figure 2G:
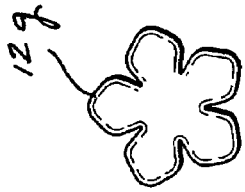
Figure 2H:
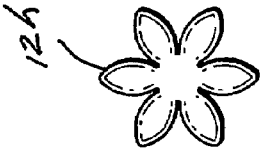
Figure 2I:
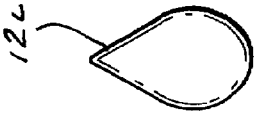
Figure 2J:
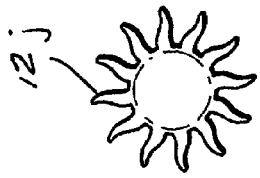
Figure 2K:
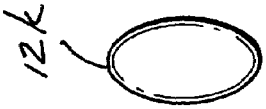
Figure 2L:
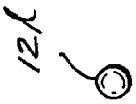
Figure 3:
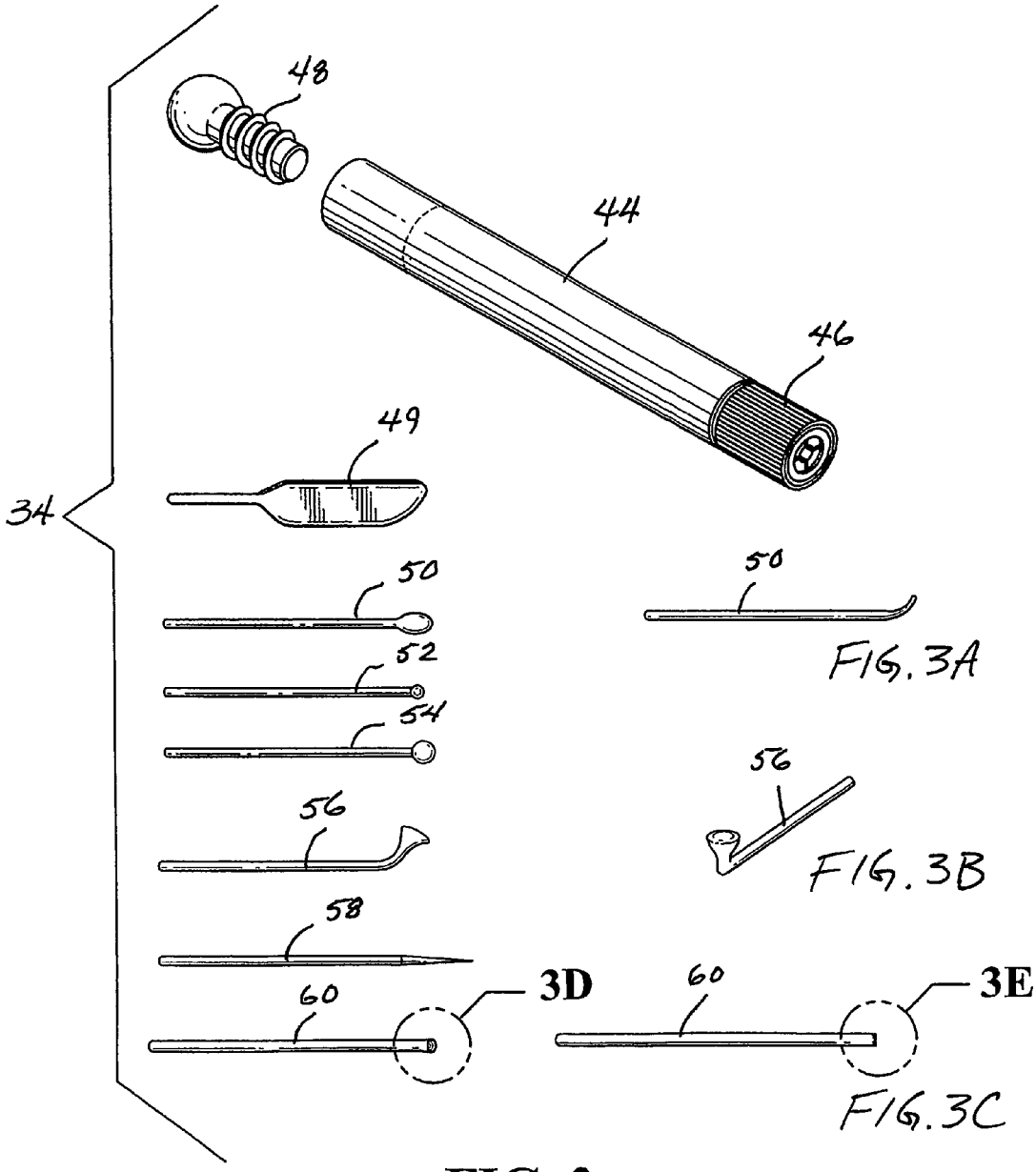
FIG. 3 is a perspective view with parts separated of a tool kit which may be incorporated in the kit of FIG. 1.
Figure 3D:
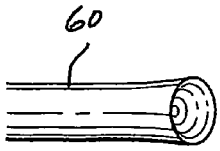
FIG. 3D is an enlarged view of the indicated area of detail of FIG. 3.
Figure 3E:
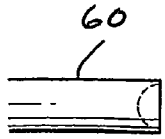
FIG. 3E is an enlarged view of the indicated area of detail of FIG. 3C.

Star-shaped flowers may be formed, for example, using star-shaped flower punches 15*c* (FIG. 2B). The flower punches are lifted with a pick and placed on a foam pad sheet 38. Small ball-tipped stylus tool 52 is placed in the center of the starflower, pressed in and turned. The flower punch deforms to resemble a horn type flower which is star shaped. The flower will have creases and crevices formed, but no dimple. Many of these flowers can be glued on top of each other offsetting the flower points to make sure the points of the flower falls in between the adjacent flower's points. When the assembled flowers dry, a hole is formed through the middle of the flower, for example by punching a hole with needle tipped tool 58. The stem is added according to the methods previously noted.

Daffodils and Narcissus type flowers may be made by turning one star-shaped flower upside down and gluing another one on top. An alternative method is to use one yellow flower or one yellow horn shaped flower, and one yellow star-shaped flower for the bottom.

For a Dafodil, make one flower as previously described herein using yellow colored flower punches or one yellow star-shaped flower and either one flower or one yellow horn-shaped flower.

For a Narcissus, use yellow card stock flower punches and make a large orange dot at the center of the flower punch. The color is dispersed as shown and described above in connection with FIGS. 5-7. The flower punch is allowed to dry and the orange/yellow flower punch is glued to the bottom of a yellow flower, or yellow star flower formed without the coloring steps. The stem is then added as noted previously.

Leaves for the Daffodils or Narcissus are made with an elongated narrow piece of green card stock. Using a pick and straight edge a line is drawn from top to bottom of the card stock. This makes an impression on the card stock and makes it easy to fold. The card stock is folded together. While holding it together, a thin strip is cut at the folded side. Then the folded strip is cut to the desired length to make the leaves. The end is trimmed to a point. To enhance the leaf, a darker colored green marker pen may be used to mark the folded portion along the crease from the bottom to almost the tip. The leaf is placed on a foil sheet and wet with a paint brush dipped in water. When the leaf is soft and pliable it is placed on a foam pad sheet 38. The leaf is then scored along the crease from the tip to the bottom. This method gives the leaf an enhanced look with the creases and added color.

The described embodiments of the present disclosure are intended to be illustrative rather than restrictive, and are not intended to represent every embodiment of the present disclosure. Various modifications and variations can be made without departing from the spirit or scope of the present disclosure as set forth in the following claims both literally and in equivalents recognized in law.

What is claimed is:

1. A method of forming miniature flowers from flower shaped paper punches comprising the steps of:

placing a flower punch formed of paper on a pliable surface;

forming at least one curve in the flower punch by pressing down with a smooth edged tool near the center of the flower punch such that the punch is pushed into the pilable surface and pulling outwardly on the smooth edged tool toward the outer edge of the flower punch;

attaching the curved flower punch to an elongated flexible stem member; and dispersing a coloring agent on the flower punch wherein the dispersing step includes the sub-steps of:

applying a water soluble color mark on the flower punch;

wetting the flower punch; and pressing the flower punch to spread the coloring agent.

2. A kit for making miniature plants or flowers which comprises:

a plurality of flower shaped paper punches formed from card stock material;

at least one miniature container configured and dimensioned to arrange and display finished miniature flowers therein;

at least one quantity of decorative particulate material;

a foam block;

an instructional video;

an instructional pamphlet;

at least one elongated flexible stem member;

at least one foam pad sheet; and a container configured and dimensioned to contain each of the kit components.

3. The kit according to claim 2, which further comprises at least one piece of rigid sheet material.

4. The kit according to claim 2, which further comprises a tool kit including a plurality of flower forming tool attachments.

* * * * *